US005581798A

United States Patent [19]

Weinl et al.

[11] Patent Number: 5,581,798

[45] Date of Patent: *Dec. 3, 1996

[54] METHOD OF PRODUCING A SINTERED CARBONITRIDE ALLOY FOR INTERMITTENT MACHINING OF MATERIALS DIFFICULT TO MACHINE

[75] Inventors: Gerold Weinl, Alvsjö ; Rolf Oskarsson, Rönninge, both of Sweden

[73] Assignee: Sandvik AB, Sandviken, Sweden

[ * ] Notice: The term of this patent shall not extend beyond the expiration date of Pat. No. 5,552,108.

[21] Appl. No.: 438,993

[22] Filed: May 11, 1995

Related U.S. Application Data

[63] Continuation of Ser. No. 78,250, Jun. 21, 1993, abandoned.

[30] Foreign Application Priority Data

Dec. 21, 1990 [SE] Sweden ..... 9004119
Dec. 19, 1991 [WO] WIPO ..... PCT/SE91/00888

[51] Int. Cl.[6] ..... B22F 3/16

[52] U.S. Cl. ..... 419/10; 419/11; 419/12; 419/13; 419/14; 419/15; 419/23; 419/33; 419/36; 419/38; 419/39

[58] Field of Search ..... 75/238; 419/10–15, 419/23, 33, 36, 38, 39

[56] References Cited

U.S. PATENT DOCUMENTS

| | | | |
|---|---|---|---|
| 3,971,656 | 7/1976 | Rudy | 75/203 |
| 3,994,692 | 11/1976 | Rudy | 482/182.5 |
| 4,049,876 | 9/1977 | Yamamoto et al. | 428/932 |
| 4,769,070 | 9/1988 | Tobioka et al. | 75/238 |
| 4,857,108 | 8/1989 | Brandt et al. | 75/238 |
| 4,904,445 | 2/1990 | Iyori et al. | 419/13 |
| 4,944,800 | 7/1990 | Kolaska et al. | 75/238 |
| 5,041,399 | 8/1991 | Fukaya et al. | 501/87 |
| 5,137,565 | 8/1992 | Thelin et al. | 75/238 |
| 5,147,831 | 9/1992 | Zeiringer | 501/96 |

*Primary Examiner*—Donald P. Walsh
*Assistant Examiner*—John N. Greaves
*Attorney, Agent, or Firm*—Burns, Doane, Swecker & Mathis, L.L.P.

[57] ABSTRACT

According to the invention there now is provided a method of producing a sintered titanium based carbonitride alloy with 3–25 weight % binder phase with extremely good properties at intermittent machining of materials difficult to machine. The method relates to the use of a raw material comprising a complex cubic carbonitride containing the main part of the metals from groups IV and V of the periodic system and carbon and nitrogen to be found in the finished alloy whereby said alloy has the composition $$0.86 \leqq X_{IV} \leqq 0.97$$

$$0.44 \leqq X_C \leqq 0.55$$

where $X_{IV}$ is the molar ratio of the group IV elements of the alloy and $X_C$ is the molar ratio of carbon.

17 Claims, 1 Drawing Sheet

Figure 1:
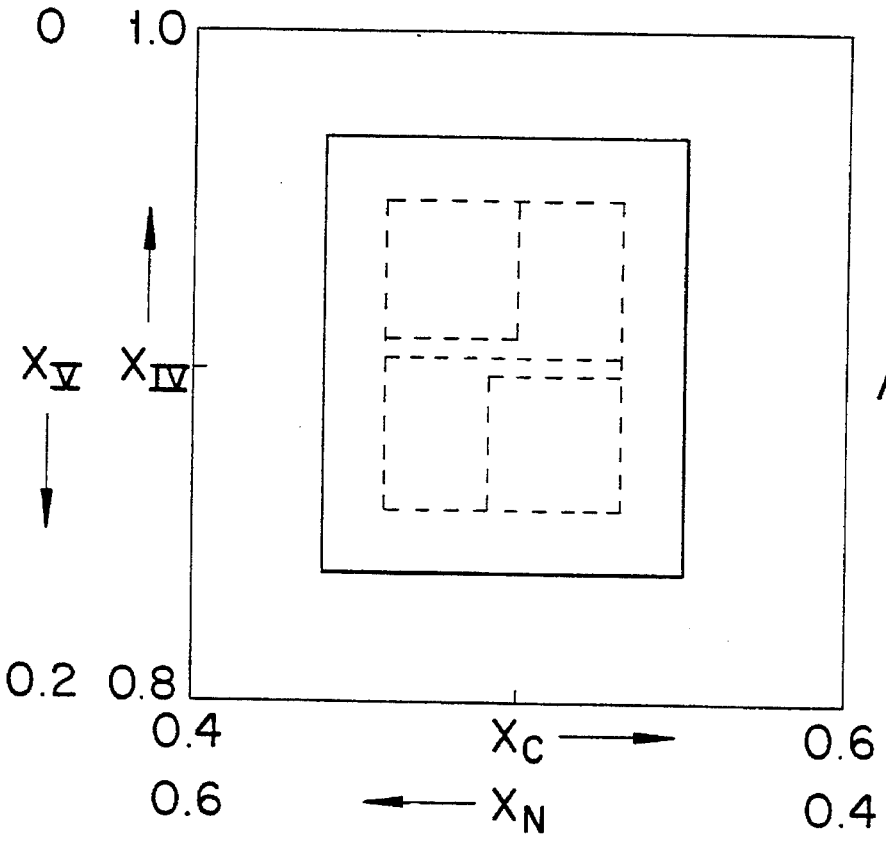

METHOD OF PRODUCING A SINTERED CARBONITRIDE ALLOY FOR INTERMITTENT MACHINING OF MATERIALS DIFFICULT TO MACHINE

This application is a continuation of application Ser. No. 08/078,250, filed Jun. 21, 1993 abandoned.

The present invention relates to a method of producing a sintered carbonitride alloy with titanium as main constituent particularly suited for intermittent machining of materials difficult to machine.

Sintered carbonitride alloys based on mainly titanium usually referred to as cermets have during the last years increased their use at the expense of more traditional cemented carbide i.e. tungsten carbide based alloys.

U.S. Pat. No. 3,971,656 discloses the production of an alloy with a duplex hard constituent where the core has a high content of Ti and N and the surrounding rim has a lower content of these two elements which is compensated for by a higher content of group VI metals i.e. in principle Mo and W and by higher carbon content. The higher content of Mo, W and C has inter alia the advantage that the wetting against the binder-phase is improved i.e. the sintering is facilitated. As a raw material a carbonitride of titanium and a group VI metal is used.

By changing the raw material it is possible to vary the core-rim-composition. In e.g. Swedish Patent Specification 459 862 it is shown how it is possible to use (Ti,Ta)C as a raw material to get a duplex structure with cores with a high content of titanium and tantalum but low content of nitrogen. The surrounding rims have higher contents of group VI-metals, i.e. molybdenum and tungsten and higher contents of nitrogen than the cores. This leads inter alia to an improved resistance against plastic deformation.

Furthermore, it has in Swedish Patent Application 8902306-3 been shown how by mixing various types of core-rim structures in one and the same alloy advantages and drawbacks can be balanced out in such a way that optimized alloys are obtained.

EP-A-259192 discloses a sintered alloy comprising a mixed carbonitride of titanium and at least one element from the group consisting of group IV, V and VI elements except titanium in a binder phase based on Co and/or Ni. The alloy is produced by mixing powders of the hard constituents, heating the mixture in a nitrogen atmosphere at a temperature of at least the sintering temperature to form a solid solution, milling said solid solution to obtain a carbonitride powder which is mixed with Co and/or Ni and sintered.

It has now turned out that if sintered titanium-based carbonitride alloys are produced using complex cubic carbonitride raw material which contains the main part, preferably >90%, most preferably >95% of the metals at least two preferably at least three from the groups IV and V in addition to carbon and nitrogen being part of the finished sintered carbonitride alloy unique structures as well as unique properties are obtained. Preferably all of the nitrogen shall be present in the mentioned carbonitride raw material.

In particular of the above-mentioned metals all titanium and tantalum shall be present in the raw material according to the invention. Preferably also vanadium, niobium and suitably also zirconium and hafnium are present if they are part of the finished sintered alloy. Metals from group VI, Cr, Mo and W, shall, if they are present, be added as multiple carbides, single carbides and/or as metal+carbon, but they may also be part of the raw material according to the invention provided that the raw material remains cubic.

The raw material according to the invention is produced directly by carbonitriding of the oxides of the metals or the metals themselves. As a result a carbonitride powder with essentially equiaxial grains and a narrow grain size distribution is obtained with a mean grain size of 0.8–3 μm, preferably 1–2 μm.

As mentioned interesting properties of a sintered carbonitride alloy are obtained if the special raw materials according to this invention are used. Thus, it has turned out that a carbonitride alloy with extremely positive properties at intermittent machining of materials difficult to machine which materials have a tendency to clad if a raw material with the composition $(Ti_{0.93},Ta_{0.07})(C_{0.48},N_{0.52})$ is used. This effect is further increased if in addition vanadium is added whereby the corresponding formula will be $(Ti_{0.88},Ta_{0.06},V_{0.06})(C_{0.51},N_{0.49})$. Corresponding inserts made from simple raw materials and in exactly the same equipment give considerably decreased properties in toughness inter alia greater scatter at the same wear resistance. This means that the reliability of such inserts is considerably decreased which means that they are not as efficient when producing with limited manning a production form with increased importance due to increasing labour costs.

One of the reasons for this positive behaviour has turned out to be that a considerably lower porosity level is obtained with this complex raw material compared to conventional raw materials without having to use any other means such as HIP and this with even lower compaction pressure than for conventional material. This is a great advantage from production point of view inter alia due to reduced tool wear and considerably lower risk for unfavourable pressing cracks.

The invention thus relates to a method of producing a titanium based carbonitride alloy with 3–25 % by weight binderphase based on Co, Ni and/or Fe using the above mentioned complex raw material. This raw material is milled together with carbides from group VI, if any, and binderphase elements and carbon addition, if any, and minor additions of e.g. TiC, TiN, TaC, VC or combinations thereof due to small deviations in composition of the complex raw material whereafter compaction and sintering, preferably in an inert atmosphere, is performed according to known technique.

Figure 2:
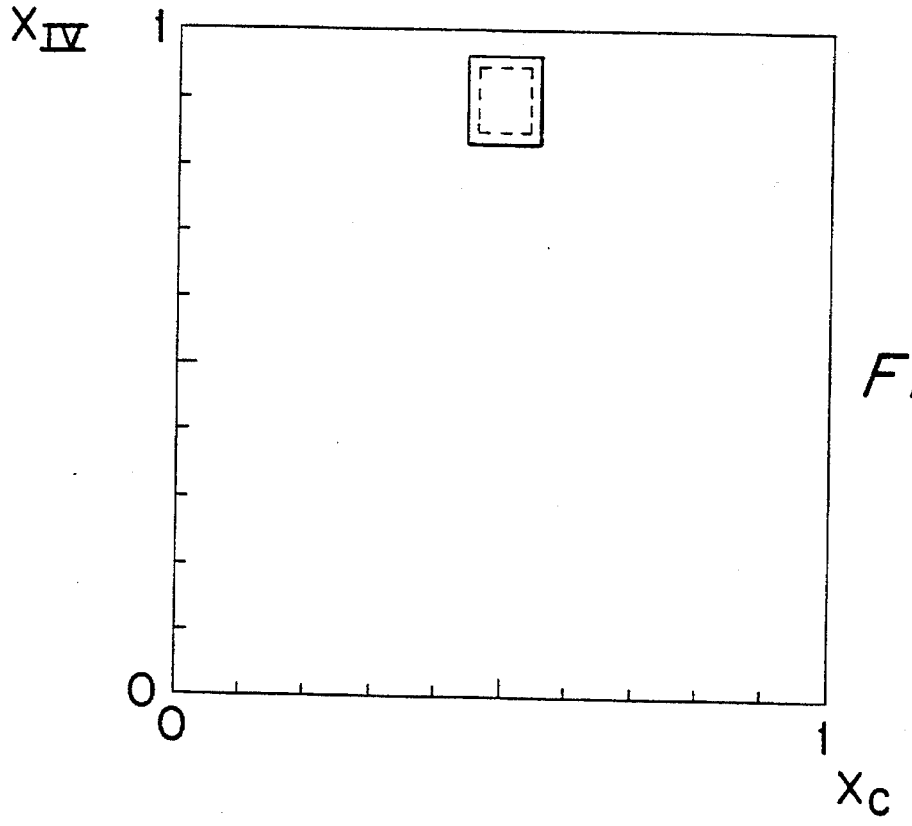

FIG. 1 shows the 'window' in the composition diagram for Group IV-Group V —C—N, expressed in molar ratio, of the complex raw material which shows the above mentioned advantages in high magnification, whereas FIG. 2 shows where in the total molar ratio diagram this small area is situated.

Group IV metals are Ti, Zr and/or Hf and Group V metals are V, Nb and/or Ta.

As is evident from FIG. 1 the window comprises the composition area:

$$0.84 \leqq X_{IV} \leqq 0.97$$

$$0.44 \leqq X_C \leqq 0.55$$

and in particular:

$$0.86 \leqq X_{IV} \leqq 0.95$$

$$0.46 \leqq X_C \leqq 0.53$$

The latter restricted window can be divided into two, one without other group V metals than Ta:

$$0.905 \leqq X_{IV} \leqq 0.95$$

$0.46 \leqq X_C \leqq 0.53$ and another one with other group V elements than Ta i.e. V and Nb:

$0.86 \leqq X_{IV} \leqq 0.905$ $0.46 \leqq X_C \leqq 0.53$

Particularly good properties are obtained for the compositions $0.91 \leqq X_{IV} \leqq 0.95$ $0.46 \leqq X_C \leqq 0.50$ respectively $0.86 \leqq X_{IV} \leqq 0.90$ $0.49 \leqq X_C \leqq 0.53$ For titanium the following applies $x_{Ti} > 0.7$ preferably $x_{Ti} > 0.75$.

The complex carbonitride raw material can be described as $(A_xB_{1-x})(C_yN_{1-y})$, where A is one or more elements from Group IV of the periodic system, B is one or more elements from Groups V and VI of the periodic system, with $0.86 \leqq x \leqq 0.97$ and $0.44 \leqq y \leqq 0.55$.

In the above given molar ratios for carbon and nitrogen usual amounts of oxygen may be present i.e. substitute carbon and nitrogen even if it is desirable to keep such amounts of oxygen low <0.8 %, preferably <0.5 %. The invention comprises stoichiometric as well as usually substoichiometric carbonitrides.

EXAMPLE

Titanium-based carbonitride alloys with 17.5 % Ni+Co binder phase were produced with the use of a complexraw material according to the invention $(Ti_{0.88},Ta_{0.06},Nb_{0.06})(C_{0.51},N_{0.49})$ as well as with the use of simple raw material: TiN, TiC and VC. In both cases also WC and $Mo_2C$ were added in addition to Co and Ni. The following compaction pressure and porosity after milling and sintering to the same grain size were obtained:

| Compaction | Porosity | pressure, N/mm$^2$ |
|---|---|---|
| Alloy according to the invention | A00 | 154 |
| Simple raw materials | A06–A08<br>B04 | 206 |

We claim:

1. A method of producing a sintered titanium-based carbonitride alloy with 3–25 weight percent binder phase, comprising steps of:

milling a complex carbonitride raw material and said binder phase to form a mixed powder composite, said complex carbonitride raw material comprising $(A_xB_{1-x})(C_yN_{1-y})$ where A is one or more elements from Group IV and B is one or more elements from Group V, with $0.86 \leqq x \leqq 0.97$ and $0.44 \leqq y \leqq 0.55$; and sintering the powder composite to produce said sintered titanium-based carbonitride alloy.

2. A method of producing a sintered titanium-based carbonitride alloy with 3–25 weight percent binder phase, comprising steps of:

milling a complex carbonitride raw material and said binder phase to form a mixed powder composite, said complex carbonitride raw material comprising $(A_xB_{1-x})(C_yN_{1-y})$ where A is one or more elements from Group IV and B is one or more elements from Group V, with $0.86 \leqq x \leqq 0.97$ and $0.44 \leqq y \leqq 0.55$; and sintering the powder composite to produce said sintered titanium-based carbonitride alloy, all of the Group IV and V elements in the alloy being added via the complex raw material.

3. The method according to claim 1, wherein said complex carbonitride raw material is cubic.

4. The method according to claim 1, wherein A consists essentially of Ti.

5. The method according to claim 1, wherein B comprises at least two Group V metals.

6. The method according to claim 1, wherein the complex raw material is $(Ti_{0.88}Ta_{0.06}V_{0.06})(C_{0.51}N_{0.49})$ or $(Ti_{0.93}Ta_{0.07})(C_{0.48}N_{0.52})$.

7. The method according to claim 1, wherein the binder phase comprises Co, Ni, Fe or mixture thereof.

8. The method according to claim 1, wherein the complex raw material is milled with additions comprising at least one addition selected from carbides of Group VI metals and combinations thereof.

9. The method according to claim 1, wherein the sintering is carried out by compaction and heating in an inert atmosphere.

10. The method according to claim 1, wherein the complex raw material comprises essentially equiaxial grains with a narrow grain size distribution and a mean grain size of 0.8–3.0 μm.

11. The method according to claim 1, wherein the complex raw material comprises essentially equiaxial grains with a narrow grain size distribution and a mean grain size of 1–2 μm.

12. The method according to claim 1, wherein the complex raw material includes Ti and Ta.

13. The method according to claim 1, wherein the complex raw material includes V, Nb, Zr, Hf or combinations thereof.

14. The method according to claim 1, wherein the complex raw material includes ≦0.8 weight % oxygen.

15. The method according to claim 1, wherein the complex raw material includes ≦0.5 weight % oxygen.

16. The method according to claim 1, wherein the raw material is produced directly by carbonitriding metals, metal oxides or mixtures thereof.

17. The method according to claim 1, wherein all of the N in the alloy is added via the complex raw material.

* * * * *